United States Patent [19]

Nagashima et al.

[11] Patent Number: 4,830,212

[45] Date of Patent: May 16, 1989

[54] WORKING MACHINE

[75] Inventors: Akira Nagashima, Kawasaki; Fujio Kobayashi, Hachioji, both of Japan

[73] Assignee: Kioritz Corporation, Tokyo, Japan

[21] Appl. No.: 151,828

[22] Filed: Feb. 3, 1988

[30] Foreign Application Priority Data

Feb. 12, 1987 [JP] Japan ..... 62-19121

[51] Int. Cl.[4] ..... B65D 25/54

[52] U.S. Cl. ..... 220/5 A; 73/323; 116/227; 220/82 R

[58] Field of Search ..... 30/381; 73/323, 334; 116/227; 220/5 A, 82 R; 280/5 A

[56] References Cited

U.S. PATENT DOCUMENTS

| | | | |
|---|---|---|---|
| 3,987,294 | 10/1976 | Carlson | 116/227 |
| 4,021,943 | 5/1977 | McMullen | 116/227 |
| 4,141,311 | 2/1979 | Taylor, Jr. | 116/227 |
| 4,376,490 | 3/1983 | Mizusaki | 116/227 |
| 4,535,910 | 8/1985 | Nagashima | 220/82 R |
| 4,590,798 | 5/1986 | Yazaki | 116/227 |
| 4,595,030 | 6/1986 | Yazaki | 116/227 |

*Primary Examiner*—Jimmy G. Foster

*Attorney, Agent, or Firm*—Browdy and Neimark

[57] ABSTRACT

A working machine with a fuel tank in a casing of the main body wherein a projecting see-through portion which extends from the casing outwardly is defined on one side of the fuel tank.

3 Claims, 1 Drawing Sheet

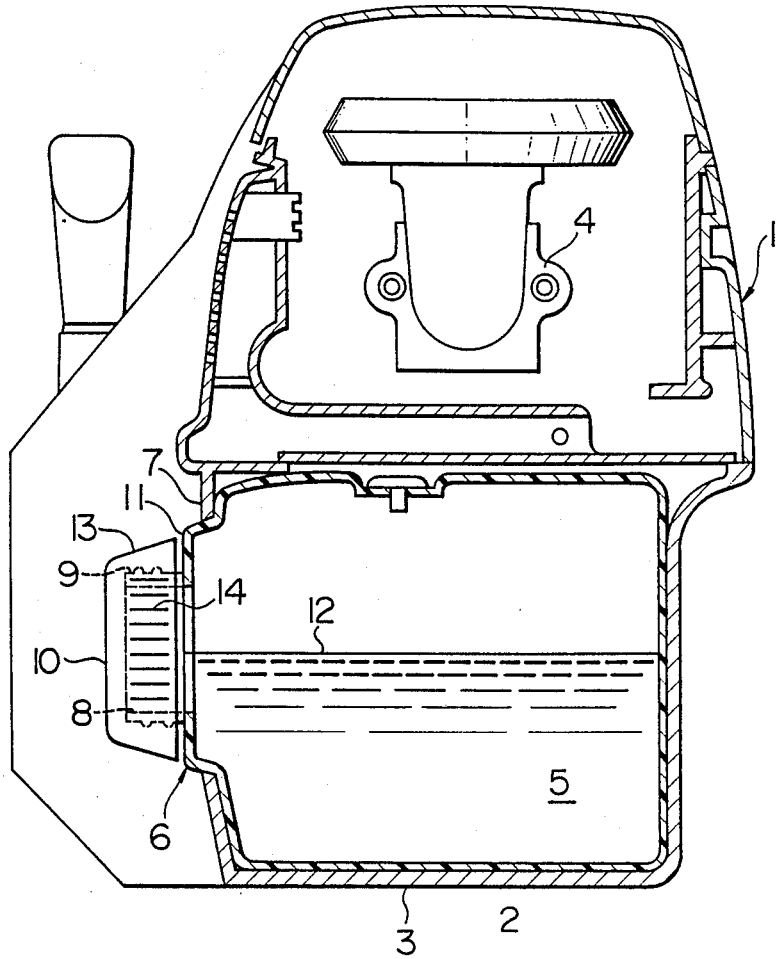
1
2
3
4
5
6
7
8
9
10
11
12
13
14

WORKING MACHINE

BACKGROUND OF THE INVENTION

1. Field of the Invention

This invention relates to a working machine such as a chain-saw.

2. Prior Art

In the conventional working machine, for example in a chain-saw, an internal combustion engine is incorporated as a power source, and a refillable fuel tank is provided to reserve fuel which is to be supplied to the internal combustion engine.

Generally, a satisfactory simple method to detect the remaining quantity within the fuel tank of the working machines has not been provided, therefore in many cases it is up to the operator to sense how much fuel is left by applying a shaking motion to the main body and listening to the sound of the fuel in the tank.

With conventional technical knowledge for the working machine, sometimes dangerous conditions develop and tedious tasks are required, such as when the engine often stops due to consumption of the fuel during operation, the tank cap of the supplying port must be removed for looking into the tank and so on, while even if a fuel meter is included for the detection of the level of remaining fuel within the tank, it does not accurately detect the level due to off-horizontal varieties in position of the main body and simply adds to the cost of the machine.

SUMMARY OF THE INVENTION

Accordingly, one object of the present invention is to solve the problems in conventional technical knowledge for working machines, and to provide a working machine having a structure so simple as to be readily manufactured, including the ability easily sense the level of the remaining fuel within the tank.

Namely, a working machine according to the present invention is characterized in that the working machine has a tank within the casing of the main body comprising a projecting see-through portion extending from the casing outwardly on one side.

According to the structure as has been described, it is thus possible to view the contents within the tank through the projected portion of the tank and sense the quantity within the tank even during operation.

BRIEF DESCRIPTION OF THE DRAWING

The drawing is a cross-sectional view of the main portion of a chain saw showing one preferred embodiment according to the present invention.

DESCRIPTION OF THE PREFERRED EMBODIMENT

The present invention will be fully described hereinafter with reference to the drawing showing one preferred embodiment.

The embodiment is an example in which the invention embodies a fuel tank of the chain-saw. In the lower portion of the main body 1 a fuel tank 2 is disposed, and the outer peripheral surface of the fuel tank 2 is covered with and protected by a casing 3 of the main body 1. The fuel tank 2 is made of relatively thin plastic and is semi-transparent, the contents of the fuel tank 2 are observable from the outside, and the fuel 5 to be supplied to an internal combustion engine (not shown) is stored in the tank 2. On one side of the fuel tank 2 a projecting cylindrical semi-transparent portion 6 which extends outwardly from the casing 3 is integrally defined, and the projecting semi-transparent portion 6 is exposedly protruded outwardly to an extension of several millimeters from an opening port 7 formed on the side of the casing 3. A fuel supplying port 8 to supply fuel into the fuel tank 2 is formed integrally on the exposed surface of the projecting semi-transparent portion 6. On the outer peripheral surface of the fuel supplying port 8 threads 9 are located and cap 10 is screwed detachably on to the threads 9. The outer diameter of the cap 10 is slightly smaller than that of the projecting semi-transparent portion 6 of the fuel tank 2, so that in the projecting semi-transparent portion 6 an annular exposed portion 11 which is exposing outwardly is defined between the opening portion 7 of the casing 3 and the cap 10. Evidently fuel within the fuel tank 2 is found within the projecting semi-transparent portion 6, too, therefore a level of fuel 5 appears at the annular exposed portion 11, a position of the level can be viewed from the outside of the cap 10 or from any location the operator takes, and the fuel amount within the fuel tank 2 is readily sensed. Moreover if a scale mark 14 is marked on the outer peripheral surface portion 13 of the cap 10, a level 12 is viewed and the remaining quantity is checked all the more easily.

What is claimed is:

1. A working machine with a fuel tank in a casing of the main body comprising a projecting see-through portion extending from the casing outwardly from a port defined in the casing on one side of the fuel tank;

a cap having an outer diameter slightly smaller than the diameter of the projecting see-through portion;

an annular exposed portion defined between the port and the cap by the smaller diameter of the cap with respect to the see-through portion;

whereby a fuel level readily appears at the annular exposed portion.

2. A working machine according to claim 1, wherein said see-through portion comprises a fuel supplying port extending outwardly of said see-through portion for supplying fuel through said portion into the tank.

3. A working machine according to claim 1, further comprising scale markings on an outer peripheral surface portion of said cap for indicating an amount of fuel remaining in the tank.

* * * * *